US005330962A

United States Patent [19]

De brabandere et al.

[11] Patent Number: 5,330,962

[45] Date of Patent: Jul. 19, 1994

[54] THERMAL DYE TRANSFER PRINTING METHOD FOR OBTAINING A HARD COPY OF A MEDICAL DIAGNOSTIC IMAGE

[75] Inventors: Luc De brabandere, Lier; Emiel Verdonck, Berlaar; Frans Feytens, Meise; Martin Pollefeyt, Brugge, all of Belgium

[73] Assignee: AGFA-Gevaert, N.V., Mortsel, Belgium

[21] Appl. No.: 974,906

[22] Filed: Nov. 12, 1992

[30] Foreign Application Priority Data

Nov. 19, 1991 [EP] European Pat. Off. ..... 91203008.7

[51] Int. Cl.[5] ..... B41M 5/035; B41M 5/38

[52] U.S. Cl. ..... 503/227; 428/195; 428/206; 428/327; 428/331; 428/409; 428/478.2; 428/480; 428/913; 428/914

[58] Field of Search ..... 8/471; 428/195, 206, 428/323, 327, 331, 913, 914, 409, 478.2; 503/227

[56] References Cited

U.S. PATENT DOCUMENTS 5,023,129 6/1991 Morganti et al. ..... 428/195

5,096,876 3/1992 Jahn et al. ..... 503/227

*Primary Examiner*—B. Hamilton Hess

*Attorney, Agent, or Firm*—Breiner & Breiner

[57] ABSTRACT

Thermal dye transfer printing method comprising the step of imagewise heating a dye-donor element comprising a support having thereon a dye layer thereby transferring a dye image to a transparant dye-image receiving element comprising a support having thereon a dye image-receiving layer and optionally having one or more back layers on the opposite side of the support, characterized in that said receiving element is such that when a dye image has been transferred onto said receiving element the specular gloss of the obtained dye image measured from the readable side of the image in areas having a transmission density of at least 2.00 is at the most 90, and transparant dye-image receiving element for use according to said method.

21 Claims, No Drawings

THERMAL DYE TRANSFER PRINTING METHOD FOR OBTAINING A HARD COPY OF A MEDICAL DIAGNOSTIC IMAGE

FIELD OF THE INVENTION

The present invention relates to a thermal dye sublimation transfer method in particular to a thermal dye sublimation transfer method for obtaining a hard copy of a medical diagnostic image and to dye-image receiving elements for use according to said method.

BACKGROUND OF THE INVENTION

Thermal dye sublimation transfer also called thermal dye diffusion transfer is a recording method in which a dye-donor element provided with a dye layer containing sublimable dyes having heat transferability is brought into contact with a receiver sheet and selectively, in accordance with a pattern information signal, heated with a thermal printing head provided with a plurality of juxtaposed heat-generating resistors, whereby dye from the selectively heated regions of the dye-donor element is transferred to the receiver sheet and forms a pattern thereon, the shape and density of which is in accordance with the pattern and intensity of heat applied to the dye-donor element.

A dye-donor element for use according to thermal dye sublimation transfer usually comprises a very thin support e.g. a polyester support, one side of which is covered with a dye layer, which contains the printing dyes. Usually an adhesive or subbing layer is provided between the support and the dye layer. Normally the opposite side is covered with a slipping layer that provides a lubricated surface against which the thermal printing head can pass without suffering abrasion. An adhesive layer may be provided between the support and the slipping layer.

A dye-image receiving element for use according to thermal dye sublimation transfer usually comprises a support, e.g. paper or a transparant film, coated with a dye-image receiving layer, into which the dye can diffuse more readily. An adhesive layer may be provided between the support and the receiving layer. On top of said receiving layer a separate release layer may be provided to improve the releasability of the receiving element from the donor element after transfer is effected.

The dye layer can be a monochrome dye layer or it may comprise sequential repeating areas of different colored dyes like e.g. of cyan, magenta, yellow and optionally black hue. When a dye-donor element containing three or more primary color dyes is used, a multicolor image can be obtained by sequentially performing the dye transfer process steps for each color.

One of the possible applications of thermal dye sublimation transfer printing is the production of hard copies of medical diagnostic images. Although such a hard copy can be produced on a reflective support such as paper, in most applications hard copies are produced on transparancies. Depending on the particular application these hard copies can be monochrome, in particular monochrome black, or multicolored.

Hard copies of medical diagnostic images produced on transparancies are read from the front of a light box through a light source.

A disadvantage of the known thermal dye sublimation transfer recording materials for producing hard copies of medical diagnostic images is that when the image produced on the thermal dye sublimation transparancy is observed from the front of a light box, small angle reflections from the near surroundings (e.g. the observer seeing himself as in a mirror, reflections from a light source approximately behind the observer) make it difficult to interpret the actual image, especially in the high density areas and hence disturb the diagnosis.

SUMMARY OF THE INVENTION

Therefore it is an object of the present invention to provide a thermal dye transfer printing method for obtaining a hard copy of a medical diagnostic image on a transparancy and a transparant receiving element for use according to said method not having the disadvantages mentioned above.

According to the present invention there is provided a transparant dye-image receiving element for use according to thermal dye transfer printing, said dye-image receiving element comprising a support having thereon a dye image-receiving layer and optionally having at least one back layer on the opposite side of the support, characterized in that said dye-image receiving element is such that when a dye image has been transferred onto said receiving element the specular gloss of the transferred dye image measured from the readable side of the image in areas having a transmission density of at least 2.00 is at the most 90.

According to the present invention there is also provided a thermal dye transfer printing method comprising the step of imagewise heating a dye-donor element comprising a support having thereon a dye layer thereby transferring a dye image to a transparant dye-image receiving element comprising a support having thereon a dye image-receiving layer and optionally having at least one back layer on the opposite side of the support, characterized in that said dye-image receiving element is such that when a dye image has been transferred onto said receiving element the specular gloss of the obtained dye image measured from the readable side of the image in areas having a transmission density of at least 2.00 is at the most 90.

Hard copies of medical diagnostic images obtained by using the method of the present invention and/or the receiving element of the present invention show less reflection than hard copies obtained by using the known thermal dye transfer printing methods and/or receiving elements and thus are easier to interpret.

DETAILED DESCRIPTION OF THE INVENTION

Specular gloss is defined as the ratio between the reflection of the sample and the reflection of a reference material (x 100).

The specular gloss is measured according to the prevailing standards ASTM D523, DIN 67530 and ISO 2813, with the angle of incidence and angle of reflection both being 20°. As reference material highly polished, plane, black glass with a refractive index of 1.567 is used; a gloss value of 100 is assigned to this reference material for each measuring geometry (i.e. for each angle of incidence and reflection). Measurements are made on a glossmeter supplied by DR LANGE GmbH, Wiesenstrasse 21, 4000 Dusseldorf 11, Germany, marked under the name Labor-Reflektometer.

The specular gloss is measured from the readable side of the image. This means that if a mirror image of the original is transferred to the receiving layer the gloss is measured from the back side of the receiving element i.e. the side opposite to the receiving layer due to the fact that the image on the hard copy is then also viewed on the light box from the back side. If a readable image of the original is transferred to the receiving layer the gloss is measured from the receiving layer side because in this case the image is viewed on the light box from the receiving layer side.

The smaller the numerical value of the resulting gloss measurement, the duller the image. According to the present invention the specular gloss of the transferred dye image is preferably at the most 80, more preferably at the most 70, still more preferably at the most 60, still more preferably at the most 50, still more preferably at the most 40 and still more preferably at the most 30, measured from the readable side of the image.

The measurement of the surface gloss is preferably carried out on image areas having a transmission density of at least 2.10, more preferably on image areas having a transmission density of at least 2.20.

Said densities can be obtained by single pass printing i.e. printing the receiving element in combination with the donor element one time or by double (or multi) pass printing i.e. printing the same receiving element a second time in register with the same area or a different area of the donor element (such printing methods are described in e.g, EP 318946, EP 452566 , and European patent application no. 91201826.4).

The density of the said image area is measured in transmission (diffuse specular according to the standard ISO 5/2) with a densitometer type Macbeth TR 924 in Status A mode in the case of monochrome colored image areas (e.g. magenta, yellow or cyan images respectively behind a green, blue and red filter) or equipped with a visual filter in the case of black images. In the case of black images areas obtained by using monochromic black or multicolored dye donor elements the transmission density is measured in the area having a visually neutral grey color (i.e. having CIE a* and b* values each within the range −8.0 to +8.0, as measured according to the standard ASTM E308 (method defined by the Commission International pour l'Eclairage)) when illuminated by a standard light source commonly used in negatoscopes for medical diagnostic applications. A non-limitative list of such light sources is given hereinafter: the TL lamps of the following types HLX 182, WWX 183, WWX, WW, W, CWX 184, CWX, UW, CW, N, DX 186, D, WWX 193, WX 194 (e.g. type F58W/CW-ST 133) all supplied by Sylvania GTE, and of the following types 29, 33, 54, 82, 83, 84, 86, 92, 93, 94, 95 (e.g. type TL'D 58W 33) all supplied by Philips. The abovementioned CIE values are net differences with respect to the CIE values of the support of the receiving element.

According to a preferred embodiment of the present invention, one of the layers of the dye-image receiving element contains an effective amount of a matting agent so that the specular gloss of the transferred image is within the ranges as defined above.

If a readable image of the original is transferred to the receiving layer the matting agent is incorporated in the dye-image receiving layer or in a layer provided on top of said dye-image receiving layer.

If a mirror image of the original is transferred to the receiving layer the matting agent is incorporated in at least one of the back layers provided on the side of the support opposite to the receiving layer.

It is preferred to incorporate the matting agent in at least one of the back layers and thus to transfer a mirror image to the receiving layer. Incorporating the matting agent in the receiving layer can lead to a less tight contact between donor element and receiving element during transfer. Further matting agents frequently are not soluble in the organic solvents in which the binder resins for the receiving layer are soluble and are frequently not dye-accepting. A supplemental advantage of incorporating the matting agent in at least one of the back layers is improved grip of the receiving element on the drum onto which the receiving element is clamped during transfer. Further incorporating matting agent in one of the back layers can improve the slip, antiblocking and general handling characteristics of the receiving element so that individual receiver sheets are easily separated from the stack of receiver sheets and are smoothly and sequentially fed to the print-head. Further incorporating matting agent in one of the back layers can also lead to more convenient manufacturing of the receiver sheet in that the transport of the receiver sheet over the different rolls during coating is improved and that during storing of coated receiver in rolled form sticking of the back side of one wrapping to the receiving side of the next wrapping is decreased.

Matting agents for use in the present invention include homopolymers of methyl methacrylate, copolymers of methyl methacrylate and methacrylic acid, copolymers of methyl methacrylate, methacrylic acid and styrene, copolymers of methyl methacrylate, styrene and maleic acid, starch or other organic compounds and fine grains of inorganic compounds such as silica, titanium dioxide, strontium compounds, barium compounds, etc. The volume mean grain size of the above matting agents is preferably from 0.3 to 10 μm, and particularly from 0.75 to 4.5 μm, more particularly from 0.75 to 2.5 μm.

A mixture of two or more matting agents may be employed, if desired.

Examples of preferred matting agents are given hereinafter:

- poly(methyl methacrylate-co-styrene-co-maleic acid) (95/2.5/2.5) having a volume mean diameter of 1 μm (matting agent no. 2; see examples hereinafter)
- poly(methyl methacrylate-co-styrene-co-maleic acid) (95/2.5/2.5) having a volume mean diameter of 2 μm (matting agent no. 1; see examples hereinafter)
- poly(methyl methacrylate-co-styrene-co-maleic acid) (95/2.5/2.5) having a volume mean diameter of 3 μm
- poly(methyl methacrylate-co-stearylmethacrylic acid) (98/2)
- poly(methyl methacrylate-co-styrene-co-maleic acid-co-stearylmethacrylic acid) (96.55/0.74/0.74/1.97) having a volume mean diameter of 3.5 μm
- poly(methyl methacrylate-co-stearylmethacrylic acid-co-styrene-co-maleic acid) (96.55/1.97/0.74/0.74) having a volume mean diameter in the range of 5 to 7 μm
- poly(methyl methacrylate-co-vinylbenzylchloride-co-acrylic acid) (90/5/5) having a volume mean diameter of about 1.5 μm
- poly(methyl methacrylate-co-stearylmethacrylic acid-co-maleic acid) (42/56/2) having a volume mean diameter in the range of 1 to 3.5 μm
- hydroxypropylmethylcellulose hexahydrophthalate (5.5–7%/16–18.5%/35–40.5%) (HPMC-HHP supplied by Shin-Etsu Chemical Company)

- poly(styrene-co-alkylmethacrylic acid) having a volume mean diameter of about 0.5 pm (Ropaque OP62 supplied by Rohm & Haas)
- silica having a volume mean diameter of 4.1 μm (Syloid 378 supplied by Grace Davison)
- silica having a volume mean diameter in the range of 0.2 to 6 μm (Millisil C800 supplied by Sibelco)
- silica having a volume mean diameter in the range of 3.8 to 4.4 μm (Syloid 72 supplied by Grace Davison)

The amount of matting agent is conveniently in a range from 2% to 30%, preferably from 5% to 15%, based on the weight of the binder resin of the layer in which the matting agent is incorporated.

The polymeric binder resin of the backing layer may be any polymer known in the art to be capable of forming a continuous, preferably uniform, film, to be transparant and be strongly adherent to the supporting substrate.

Suitable polymeric binders include: gelatine (which can be modified), starch, dextranes (which can be modified), polycarbonates, cellulose esters, cellulose ethers, homo-and copolyesters, vinylpolymers (e.g. polyvinylalcohol, polyvinylacetate, polyvinylchloride), vinylcopolymers (e.g. poly(vinylchloride-co-vinylacetate-co-vinylalcohol)), (meth)acryl polymers such as copolymers of acrylic acid and/or methacrylic acid and/or their lower alkyl (up to 6 carbon atoms) esters (e.g. copolymers of ethyl acrylate and methyl methacrylate, copolymers of methyl methacrylate/butyl acrylate/acrylic acid typically in the molar proportions 55/27/18% and 36/24/40%, and especially copolymers containing hydrophilic functional groups, such as copolymers of methyl methacrylate and methacrylic acid, and crosslinkable copolymers, e.g. comprising approximate molar proportions 46/46/8% respectively of ethyl acrylate/methyl methacrylate/acrylamide or methacrylamide), styrene copolymers (e.g. poly(styrene-co-acrylonitrile)), polyurethanes, polyamides and polyimides.

The back layer may also comprise a crosslinked binder cured by the action of heat or UV or electron beam radiation (e.g. the heat-cured product of poly(vinylchloride-co-vinylacetate-co-vinylalcohol) and polyisocyanate).

Electronic conducting polymers can also be used as binder for the back layer. Examples of such polymers are described in Chapter 3 of 'Introduction to synthetic electrical conductors', Academic Press, 1987. Among these conducting polymers, polyanilines, polythiophenes (such as described in EP 440957 and DE 4003720) and polypyrhol and their derivatives are highly recommended.

Mixtures of one or more of the above listed polymers can also be used as binder for the back layer.

The thickness of the backing layer(s) may extend over a considerable range but generally will be in a range of from 1 to 10 μm. Some of the matting agent particles may protrude from the free surface of the backing layer(s). Desirably, therefore, the thickness of the backing layer(s) is from about 1 to 4 μm.

The back coating layer(s) may contain an additive, for example, an antistatic agent (such as a copolymer of acrylic acid potassium salt, acrylic acid, methylacrylate and tetraallyloxyethane), antioxidant, stabilizer, plasticizer, dispersing agent, lubricant, wetting agents (such as 1-isobutyl-6-methyl-octylsulfate sodium salt and ammonium perfluorodecylcarboxylate), if necessary.

In case more than one backing layer is provided on the opposite side of the support the matting agent is preferably contained in the outermost backing layer. Antistatic agents may then, for example, be incorporated in the innermost backing layer.

Formation of the backing layer(s) may be effected by techniques known in the art, the layer being conveniently applied to the supporting substrate from a coating composition comprising a solution or dispersion of the binder resin and other ingredients (such as e.g. the matting agent) in a volatile medium.

Due to the fact that a lot of the above listed matting agents are not soluble in water, aqueous coating media may be employed provided the polymeric binder is capable of film-formation into a continuous uniform coating, generally when applied from an aqueous solution, dispersion or latex. Alternatively, the volatile liquid medium is a common organic solvent or a mixture of solvents in which the polymeric binder is soluble and is also such that the matting agent particles do not dissolve in the coating composition. Suitable organic solvents include methanol, acetone, ethanol and methyl ethyl ketone. Minor amounts of other solvents such as methylene chloride, diacetone alcohol and methoxy propan-2-ol may also be used in admixture with such solvents.

The applied coating medium is subsequently dried to remove the volatile medium and, if appropriate, to effect crosslinking of the binder components. Drying may be effected by conventional techniques, for example, by passing the coated film substrate through a hot air oven. Drying may, of course, be effected during normal post-formation film-treatments, such as heat-setting.

Formation of the backing layer(s) by application of a liquid coating composition may be effected at any convenient stage in the production of the receiver sheet.

The dye-image-receiving layer of the receiving element of the present invention may comprise as binder, which has to be transparant, for example, a polycarbonate, a polyurethane, a polyester, a polyamide, polyvinyl chloride, polystyrene-co-acrylonitrile, polycaprolactone or mixtures thereof. Suitable dye-receiving layers have been described in e.g. EP 133011, EP 133012, EP 144247, EP 227094, EP 228066. The dye-image-receiving layer may also comprise a cured binder such as the heat-cured product of poly(vinylchloride-co-vinylacetate-co-vinylalcohol) and polyisocyanate.

The total amount of binder used in the dye receiving layer of the present invention is from 25 to 95% by weight, preferably from 50 to 80% by weight.

The dye receiving element of the present invention can contain a release agent for improvement of the release property with respect to the donor element. As the release agent, solid waxes such as polyethylene wax, amide wax, and Teflon powder; fluorine based and phosphate ester based surfactants; and paraffin based, silicone based and fluorine based oils can be used. Silicone oils, preferably reactive silicone oils (such as hydroxy modified polydimethylsiloxane e.g. TEGOMER HSI 2111 supplied by Goldschmidt) and silicone containing copolymers such as polysiloxane-polyether copolymers and blockcopolymers, are preferred (e.g. TEGOGLIDE supplied by Goldschmidt and SILWET supplied by Union Carbide).

High boiling organic solvents or thermal solvents or plasticizers can be included in the image-receiving layer, as substances which can accept or dissolve the dyes or as diffusion promotors for the dyes. Useful examples of such high boiling organic solvents and thermal solvents include the compounds disclosed in, for example, JP 62/174754, JP 62/245253, JP 61/209444, JP 61/200538, JP 62/8145, JP 62/9348, JP 62/30247, JP 62/136646.

Also, for further enhancing the light resistance of the transferred image, one or two or more kinds of additives such as UV-ray absorbers, light stabilizers and antioxidants, can be added, if necessary. The amounts of these UV-ray absorbers and light stabilizers is preferably 0.05 to 10 parts by weight and 0.5 to 15 parts by weight, respectively, per 100 parts of the resin constituting the receiving layer.

The dye-receiving layer of the present invention preferably has an overall thickness of from 0.5 to 50 μm, more preferably from 2.5 to 10 μm.

In case a toplayer containing a release agent of the type described above is provided on top of the receiving layer the thickness of such a toplayer is preferably 0.01 to 5 μm, particularly 0.05 to 2 μm.

As the support for the receiver sheet a transparant film or sheet of various plastics such as polyethylene terephthalate, polyolefin, polyvinyl chloride, polystyrene, polycarbonate, polyether sulfone, polyimide, cellulose ester or polyvinyl alcohol-co-acetal is used. Blue-colored polyethylene terephthalate film can also be used as long as it remains transparant; transparant being defined as having the property of transmitting light without appreciable scattering. In general the support has a thickness of at least 100 μm so that the hard copy can be easily put on a light box. The thickness of the support is preferably in the range of 120 to 200 μm, more preferably in the range of 160 to 190 μm, more preferably from 170 to 180 μm.

The adhesion of a coating composition to the substrate may be improved by providing a subbing layer between the substrate and the coating layer (e.g. the receiving layer and/or the back layer). Particularly preferred subbing layers for polyethylene terephthalate supports (particularly for gelatine based back layers) are subbing layers based on copolymers of vinylidene chloride such as described in GB 1234755.

The image receiving element of the present invention may also have one or more intermediate layers between the support and the image receiving layer. Depending on the material from which they are formed, the intermediate layers may function as cushioning layers, porous layers (as long as they remain transparant) or dye diffusion preventing layers, or may fulfill two or more of these functions, and they may also serve the purpose of an adhesive, depending on the particular application.

The material constituting the intermediate layer may include, for example, an urethane resin, an acrylic resin, an ethylenic resin, a butadiene rubber, or an epoxy resin. The thickness of the intermediate layer is preferably from 1 to 20 μm.

Dye diffusion preventing layers are layers which prevent the dye from diffusing into the support. The binders used to form these layers may be water soluble or organic solvent soluble, but the use of water soluble binders is preferred, and especially gelatin is most desirable.

Porous layers are layers which prevent the heat which is applied at the time of thermal transfer from diffusing from the image receiving layer to the support to ensure that the heat which has been applied is used efficiently and possibly preventing deformation of the support.

Also, the image receiving element of the present invention can have antistatic treatment applied to the front or back surface thereof. Such antistatic treatment may be carried out by incorporating an antistatic agent in, for example, the image receiving layer or in an antistatic layer applied upon or under the image receiving surface. A similar treatment can also be effected to the back surface. By such treatment, mutual sliding between the image receiving sheets can be smoothly performed, and there is also the effect of preventing the attachment of dust on the image receiving sheet.

Furthermore, the image receiving sheet can have a lubricating layer provided on the back surface of the sheet support. The material for the lubricating layer may include methacrylate resins such as methyl methacrylate, etc. or corresponding acrylate resins, vinyl resins such as vinyl chloride-vinyl acetate copolymers.

Further the receiving element can have a notch to discriminate the receiving layer side from the back layer side.

A dye-donor element for use according to thermal dye sublimation transfer in combination with the present receiving element usually comprises a very thin support e.g. a polyester support, one side of which is covered with a dye layer, which contains the printing dyes. Usually an adhesive or subbing layer is provided between the support and the dye layer. Normally the opposite side is covered with a slipping layer that provides a lubricated surface against which the thermal printing head can pass without suffering abrasion. An adhesive layer may be provided between the support and the slipping layer.

The dye layer can be a monochrome dye layer or it may comprise sequential repeating areas of different colored dyes like e.g. of cyan, magenta, yellow and optionally black hue. When a dye-donor element containing three or more primary color dyes is used, a multicolor image can be obtained by sequentially performing the dye transfer process steps for each color.

The dye layer of such a thermal dye sublimation transfer donor element is formed preferably by adding the dyes, the polymeric binder medium, and other optional components to a suitable solvent or solvent mixture, dissolving or dispersing the ingredients to form a coating composition that is applied to a support, which may have been provided first with an adhesive or subbing layer, and dried.

The dye layer thus formed has a thickness of about 0.2 to 5.0 μm, preferably 0.4 to 2.0 μm, and the ratio of dye to binder is between 9:1 and 1:3 by weight, preferably between 2:1 and 1:2 by weight.

As polymeric binder the following can be used: cellulose derivatives, such as ethyl cellulose, hydroxyethyl cellulose, ethylhydroxy cellulose, ethylhydroxyethyl cellulose, hydroxypropyl cellulose, methyl cellulose, nitrocellulose, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates such as a polycarbonate derived from 2,2-bis-(4-hydroxyphenyl )-propane;

copolystyrene-acrylonitrile; polysulfones; polyphenylene oxide; organosilicones, such as polysiloxanes; epoxy resins and natural resins, such as gum arabic. Preferably cellulose acetate butyrate or copolystyrene-acrylonitrile(-butadieen) is used as binder for the dye layer.

Any dye can be used in such a dye layer provided it is easily transferable to the dye-image-receiving layer of the receiver sheet by the action of heat.

Typical and specific examples of dyes for use in thermal dye sublimation transfer have been described in, e.g., EP 485665, EP 209990, EP 209991, EP 216483, EP 218397, EP 227095, EP 227096, EP 229374, EP 235939, EP 247737, EP 257577, EP 257580, EP 258856, EP 279330, EP 279467, EP 285665, EP 400706, EP 432313, EP 432314, EP 432829, EP 453020, US 4743582, US 4753922, U.S. Pat. No. 4753923, U.S. Pat. No. 4757046, U.S. Pat. No. 4769360, U.S. Pat. No.4771035, JP 84/78894, JP 84/78895, JP 84/78896, JP 84/227490, JP 84/227948, JP 85/27594, JP 85/30391 , JP 85/229787, JP 85/229789, JP 85/229790, JP 85/229791, ,1P 85/229792, JP 85/229793, JP 85/229795, JP 86/41596, JP 86/268493, JP 86/268494, JP 86/268495 and JP 86/284489.

The coating layer may also contain other additives, such as curing agents, preservatives, organic or inorganic fine particles, dispersing agents, antistatic agents, defoaming agents, viscosity controlling agents, etc., these and other ingredients being described more fully in EP 133011, EP 133012, EP 111004 and EP 279467.

Any material can be used as the support for the dye-donor element provided it is dimensionally stable and capable of withstanding the temperatures involved, up to 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a polyethylene terephthalate support. In general, the support has a thickness of 2 to 30 μm. The support may also be coated with an adhesive or subbing layer, if desired.

The dye layer of the dye-donor element may be coated on the support or printed thereon by a printing technique such as a gravure process.

A dye-barrier layer comprising a hydrophilic polymer may also be employed in the dye-donor element between its support and the dye layer to improve the dye transfer densities by preventing wrong-way transfer of dye towards the support. The dye barrier layer may contain any hydrophilic material which is useful for the intended purpose. In general, good results have been obtained with gelatin, polyacryl amide, polyisopropyl acrylamide, butyl methacrylate grafted gelatin, ethyl methacrylate grafted gelatin, ethyl acrylate grafted gelatin, cellulose monoacetate, methyl cellulose, polyvinyl alcohol, polyethylene imine, polyacrylic acid, a mixture of polyvinyl alcohol and polyvinyl acetate, a mixture of polyvinyl alcohol and polyacrylic acid or a mixture of cellulose monoacetate and polyacrylic acid. Suitable dye barrier layers have been described in e.g. EP 227091 and EP 228065. Certain hydrophilic polymers, for example those described in EP 227091, also have an adequate adhesion to the support and the dye layer, thus eliminating the need for a separate adhesive or subbing layer. These particular hydrophilic polymers used in a single layer in the donor element thus perform a dual function, hence are referred to as dye-barrier/-subbing layers.

Preferably the reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Suitable slipping layers are described in e.g. EP 138483, EP 227090, U.S. Pat. No. 4567113, U.S. Pat. No. 4572860, U.S. Pat. No. 4717711. Preferably the slipping layer comprises as binder a styrene-acrylonitrile copolymer or a styrene-acrylonitrile-butadiene copolymer or a cellulose ester or a polycarbonate derived from 2,2-bis-(4-hydroxyphenyl )-propane and as lubricant in an amount of 0.1 to 10% by weight of the binder (mixture) a polysiloxane-polyether copolymer or polytetrafluoroethylene.

The dye layer of the dye-donor element may also contain a releasing agent that aids in separating the dye-donor element from the dye-receiving element after transfer. The releasing agents can also be applied in a separate layer on at least part of the dye layer. For the releasing agent solid waxes, fluorine- or phosphate-containing surfactants and silicone oils are used. Suitable releasing agents are described in e.g. EP 133012, JP 85/19138, EP 227092.

The dye-receiving elements according to the invention are used to form a dye transfer image. Such a process comprises placing the dye layer of the donor element in face-to-face relation with the dye-receiving layer of the receiver sheet and imagewise heating from the back of the donor element. The transfer of the dye is accomplished by heating for about several milliseconds at a temperature of 400° C.

When the process is performed for but one single color, a monochrome dye transfer image is obtained. A multicolor image can be obtained by using a donor element containing three or more primary color dyes and sequentially performing the process steps described above for each color. The above sandwich of donor element and receiver sheet is formed on three occasions during the time when heat is applied by the thermal printing head. After the first dye has been transferred, the elements are peeled apart. A second dye-donor element (or another area of the donor element with a different dye area) is then brought in register with the dye-receiving element and the process repeated. The third color and optionally further colors are obtained in the same manner.

In addition to thermal heads, laser light, infrared flash or heated pens can be used as the heat source for supplying heat energy. Thermal printing heads that can be used to transfer dye from the dye-donor element to the receiver sheet are commercially available. In case laser light is used, the dye layer or another layer of the dye element has to contain a compound that absorbs the light emitted by the laser and converts it into heat, e.g. carbon black.

Alternatively, the support of the dye-donor element may be an electrically resistive ribbon consisting of, for example, a multi-layer structure of a carbon loaded polycarbonate coated with a thin aluminum film. Current is injected into the resistive ribbon by electrically addressing a print head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology compared to the thermal head technology where the various elements of the thermal head get hot and must cool down before the head can move to the next printing position.

The method of the present invention is used to produce hard copies, in particular black-and-white hard copies of medical diagnostic images especially in ultrasound. C-arm surgery and nuclear medicine applications.

The following examples are provided to illustrate the invention in more detail without limiting, however, the scope thereof.

EXAMPLES

A dye donor element was prepared as follows:

A solution comprising 8 wt % dye A, 4.8 wt % dye B, 4 wt % dye C, 8 wt % of poly(styrene-co-acrylonitrile) as binder and 2.5 wt % of octanediol as thermal solvent in methylethylketone as solvent was prepared. From this solution a layer having a wet thickness of 10 μm was coated on 5 μm thick polyethylene terephthalate film. The resulting layer was dried by evaporation of the solvent.

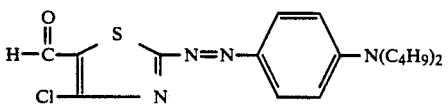

dye A

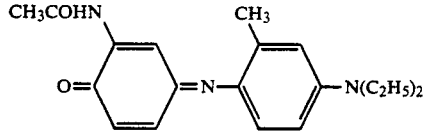

dye B

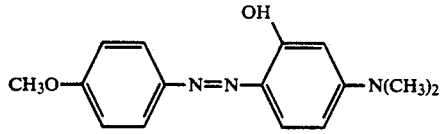

dye C

The back side of the polyethylene terephthalate film was provided with a slipping layer coated from a solution containing 13 wt % poly(styrene-co-acrylonitrile) binder and 1 wt % polysiloxane-polyether copolymer as lubricant in methylethylketone as solvent.

Dye-image receiving elements were prepared as follows:

A blue-colored polyethylene terephthalate film of 175 μm provided on both sides with a subbing layer comprising a copolymer of vinylidene chloride was coated (wet layer thickness 40 μm) with a composition for forming the receiving layer comprising 94 g of poly(vinylchloride-co-vinylacetate-co-vinylalcohol) (91/3/6 wt %) (sold under the tradename VINYLITE VAGD by Union Carbide. Old Ridgeburry Road, Danbury, USA) and 13 g of diphenylmethane 4,4'-diisocyanate (sold under the tradename DESMODUR VL by Bayer, Leverkusen, Germany) dissolved in 893 g of methyl ethyl ketone. Dry weight of the obtained dye-image receiving layer was 4.3 g/m$^2$. On top of said layer a release layer was provided. This release layer was coated (wet layer thickness 31 μm) from a composition comprising 13.7 g of poly(vinylchloride-co-vinylacetate-co-vinylalcohol) (91/3/6 wt %)(sold under the tradename VINYLITE VAGD by Union Carbide) and 7.6 g of a hydroxy modified polydimethylsiloxane (sold under the tradename TEGOMER HSI 2111 by Th. Goldschmidt AG, Goldschmidtstrasse 100, Essen, Germany) and 0.11 g of dibutyltindilaurate (sold under the tradename STAVINOR 1250 SN by Rousselot SA, Rue Christophe Colomb, Paris, France) as catalyst dissolved in 978 g of methyl ethyl ketone. Dry weight of the obtained release toplayer was 0.69 g/m$^2$. After coating the layers were dried and heat-cured.

On the opposite side of the support a back layer was provided. Said back layer was bead coated from an aqueous solution (wet layer thickness 30 μm). The coating composition contained: gelatine (37 g/l), formaldehyde as hardener (4 wt % based on the gelatine), wetting agents and a matting agent the nature and amount of which is indicated in table 1 below.

TABLE 1

| Example no. | Matting agent | Amount (g/m$^2$) |
|---|---|---|
| 1 | No. 1 | 0.075 |
| 2 | No. 1 | 0.100 |
| 3 | No. 1 | 0.15 |
| 4 | No. 2 | 0.037 |
| 5 | No. 2 | 0.075 |
| 6 | No. 2 | 0.113 |
| 7 (a) | No. 2 | 0.113 |
| 8 (a) | No. 1 | 0.15 |

(a) In examples nos 7 and 8 the back layer of the receiving element further contains 0.33 g/m$^2$ of an antistatic agent (a copolymer of acrylic acid potassium salt, acrylic acid, methylacrylate and tetraallyloxyethane). Further in examples nos 7 and 8 another dye donor element was used differing in dye composition (namely comprising 8 wt % dye A, 2.4 wt % dye B and 6.4 wt % dye D).

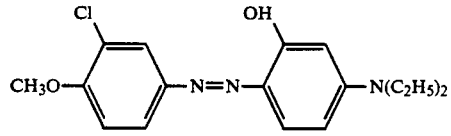

dye D

The obtained dye receiving element was printed in combination with the dye-donor element in a Mitsubishi video printer type CP 100E.

The receiver sheet was separated from the dye-donor element and the specular gloss of the obtained black-and white image was measured from the back layer side in an area having a visually neutral grey color and having a transmission density as indicated in table 2 below. The specular gloss was measured with the angle of incidence and the angle of reflection both being 20° with a Labor-Reflektometer supplied by DR LANGE. The transmission density was measured with a densitometer type Macbeth TR 924 equipped with a visual filter.

The results are listed in table 2 below.

TABLE 2

| Example no. | Density | Gloss |
|---|---|---|
| 1 | 2.20 | 42.3 |
| 2 | 2.20 | 36.1 |

TABLE 2-continued

| Example no. | Density | Gloss |
|---|---|---|
| 3 | 2.20 | 27 |
| 4 | 2.20 | 39.4 |
| 5 | 2.20 | 24.9 |
| 6 | 2.20 | 18.6 |
| 7 | 2.20 | 30.5 |
| 8 | 2.20 | 39.5 |

All the above obtained images showed considerably less undersired reflections in high density areas when viewed on a light box than images obtained when using commercially available dye transfer printing materials.

We claim:

1. Transparant dye-image receiving element for use according to thermal dye transfer printing, said dye-receiving element comprising a support having thereon a dye image-receiving layer, said dye-image receiving element being such that when a dye image has been transferred onto said receiving element the specular gloss of the transferred dye image measured from the readable side of the image in areas having a transmission density of at least 2.00 is at the most 90.

2. Transparant dye-image receiving element according to claim 1, wherein said dye-image receiving element is such that when a dye image has been transferred onto said receiving element the specular gloss of the transferred dye image measured from the readable side of the image in areas having a transmission density of at least 2.00 is at the most 50.

3. Transparant dye-image receiving element according to claim 2, wherein said dye-image receiving element is such that when a dye image has been transferred onto said receiving element the specular gloss of the transferred dye image measured from the readable side of the image in areas having a transmission density of at least 2.00 is at the most 30.

4. Transparant dye-image receiving element according to claim 1, wherein the said specular gloss is measured in areas having a transmission density of at least 2.20.

5. Transparant dye-image receiving element according to claim 1, wherein the said transmission density is obtained by single pass printing.

6. Transparant dye-image receiving element according to claim 1, wherein a layer of the dye-image receiving element contains a matting agent.

7. Transparant dye-image receiving element according to claim 6, wherein the volume mean grain size of the matting agent is from 0.75 to 4.5 μm.

8. Transparant dye-image receiving element according to claim 6, wherein the matting agent is silica or a copolymer of methylmethacrylate, styrene and maleic acid.

9. Transparant dye-image receiving element according to claim 6, wherein the amount of matting agent is between 5 and 15% by weight of the binder resin.

10. Transparant dye-image receiving element according to claim 6, wherein the matting agent is contained in one or more of the back layers.

11. Transparant dye-image receiving element according to claim 10, wherein the binder resin of the back layer is gelatine.

12. Transparant dye-image receiving element according to claim 10, wherein at least one of the back layers comprises an antistatic agent.

13. Transparant dye-image receiving element according to claim 1, wherein the support is transparant non-colored polyethylene terephthalate or transparant blue-colored polyethylene terephthalate.

14. Transparant dye-image receiving element according to claim 13, wherein the support is provided on one side or on both sides with a subbing layer comprising a copolymer of vinylidene chloride.

15. Transparant dye-image receiving element according to claim 1, wherein the support has a thickness of a least 120 μm.

16. The transparent dye-image receiving element according to claim 1 wherein said dye-image receiving layer has at least one backing layer containing a polymeric binder on the opposite side of the support.

17. Thermal dye transfer printing method comprising the step of imagewise heating a dye-donor element comprising a support having thereon a dye layer thereby transferring a dye image to a transparant dye-image receiving element, comprising a support having thereon a dye image-receiving layer, said dye-image receiving element being such that when a dye image has been transferred onto said receiving element the specular gloss of the transferred dye image measured from the readable side of the image in areas having a transmission density of at least 2.00 is at the most 90.

18. Thermal dye transfer printing method according to claim 17, wherein said method is used to obtain a hard copy of a medical diagnostic image.

19. Thermal dye transfer printing method according to claim 18, wherein said hard copies are black-and-white hard copies.

20. Thermal dye transfer printing method according to claim 17, wherein the heating is effected by laser light.

21. The transparent dye-image receiving element according to claim 17 wherein said dye-image receiving layer has at least one backing layer containing a polymeric binder on the opposite side of the support.

* * * * *